US006105759A

United States Patent [19]

Fuchs et al.

[11] Patent Number: 6,105,759

[45] Date of Patent: Aug. 22, 2000

[54] FOLDING BOX FOR RECEIVING A ROD-LIKE ARTICLE

[75] Inventors: Michael Fuchs, Dischingen; Herbert Roderwieser, Lindlar, both of Germany

[73] Assignee: Patent-Treuhand-Gesellschaft fuer elektrische Gluehlampen mbH, Munich, Germany

[21] Appl. No.: 09/412,281

[22] Filed: Oct. 5, 1999

[30] Foreign Application Priority Data

Oct. 9, 1998 [DE] Germany ..... 298 18 099 U

[51] Int. Cl.[7] ..... B64D 85/20

[52] U.S. Cl. ..... 206/218; 206/485; 206/784

[58] Field of Search ..... 206/418, 419, 206/528, 443, 446, 485, 784

[56] References Cited

U.S. PATENT DOCUMENTS 2,448,401 8/1948 Stone ..... 206/418
4,099,612 7/1978 Hanson ..... 206/418 X

FOREIGN PATENT DOCUMENTS 40 24 112 A1 2/1992 Germany .

*Primary Examiner*—Jacob K. Ackun
*Attorney, Agent, or Firm*—William E. Meyer

[57] ABSTRACT

A folding carton for an elongated object, such as a double ended electric lamp is disclosed. The carton includes cut out retentions formed in the end flaps of the carton to position the elongated object.

10 Claims, 1 Drawing Sheet

FOLDING BOX FOR RECEIVING A ROD-LIKE ARTICLE

TECHNICAL FIELD

The invention relates to a folding box for receiving at least one rod-like article, e.g. a pen, a tubular lamp or the like.

BACKGROUND ART

A folding box of this type is known from DE 40 24 112 A1. The abovementioned document describes a folding box for receiving a plurality of serum ampoules. It is of a flat form, which is similar to that for packaging chocolates, and comprises a single-piece blank in which a swing-cover section, a rear-wall section, a base section, a front-wall section and an insert section, which is provided with through-passages and a cut-out, are formed one behind the other. The insert section bears side-wall sections and closure flaps which can be folded over once the folding box has been erected. With the folding box closed, the insert section is located with its border region in the plane of the cover section, while its inner portions, provided with cut-outs, are folded over in the direction of the base section. The folding box can be supplied to the packager in the flat state, its blank already provided with adhesive, and is erected, filled and closed there without any further adhesive bonding being necessary. However, a considerable amount of material is used for this packaging.

For packaging tubular lamps, in particular tubular halogen lamps for household use, use is made of narrow folding boxes which are usually square in cross section and are closed at the end sides by folding tabs and insertion flaps. The tubular lamp is accommodated within the folding box in a bag which is made of stiff paper and keeps the lamp at a distance from the walls of the folding box in order to provide protection against breakage. Other solutions make provision for the tubular lamp in the folding box to be secured against damage by a wrapper made of padding material. This type of packaging involves high outlay since it requires a two-stage packaging operation, by way of which the lamp must first of all be wrapped and then introduced, with its wrapper, into the folding box as outer packaging. Moreover, the lamp is merely accommodated loosely in the packaging.

DISCLOSURE OF THE INVENTION

The object of the invention is to specify a folding box of the type mentioned in the introduction which is suitable for accommodating, with impact protection, at least one rod-like article, e.g. a pen, a tubular lamp or the like, and can be easily produced and filled and requires just a small amount of material to be used.

This object is achieved by the features specified in claim 1. Advantageous configurations of the invention form the subject matter of the subclaims.

The folding box according to the invention is considerably smaller and more compact than the known folding box intended for the same purpose, it gives rise to a reduction of approximately 30% in the amount of material used and improves the logistics, i.e. it is possible for more products to be accommodated per carrier. The packaging is in a single piece since the inner packaging is dispensed with. When the pack is open, the packaging contents can be removed from above, i.e. the folding box provides better presentation. It is also possible to integrate an originality closure. The simplicity of the folding box permits high packaging rates. The packaging contents, e.g. the tubular lamp, are held securely in the folding box by the laterally swung-in tabs which, by way of punched-out portions and tongues, fix the lamp securely and keep it at a reliable distance from all the walls of the packaging.

BRIEF DESCRIPTION OF THE DRAWINGS

The invention is explained hereinbelow with reference to an exemplary embodiment illustrated in the drawings, in which.

BEST MODE FOR CARRYING OUT THE INVENTION

Figure 1:
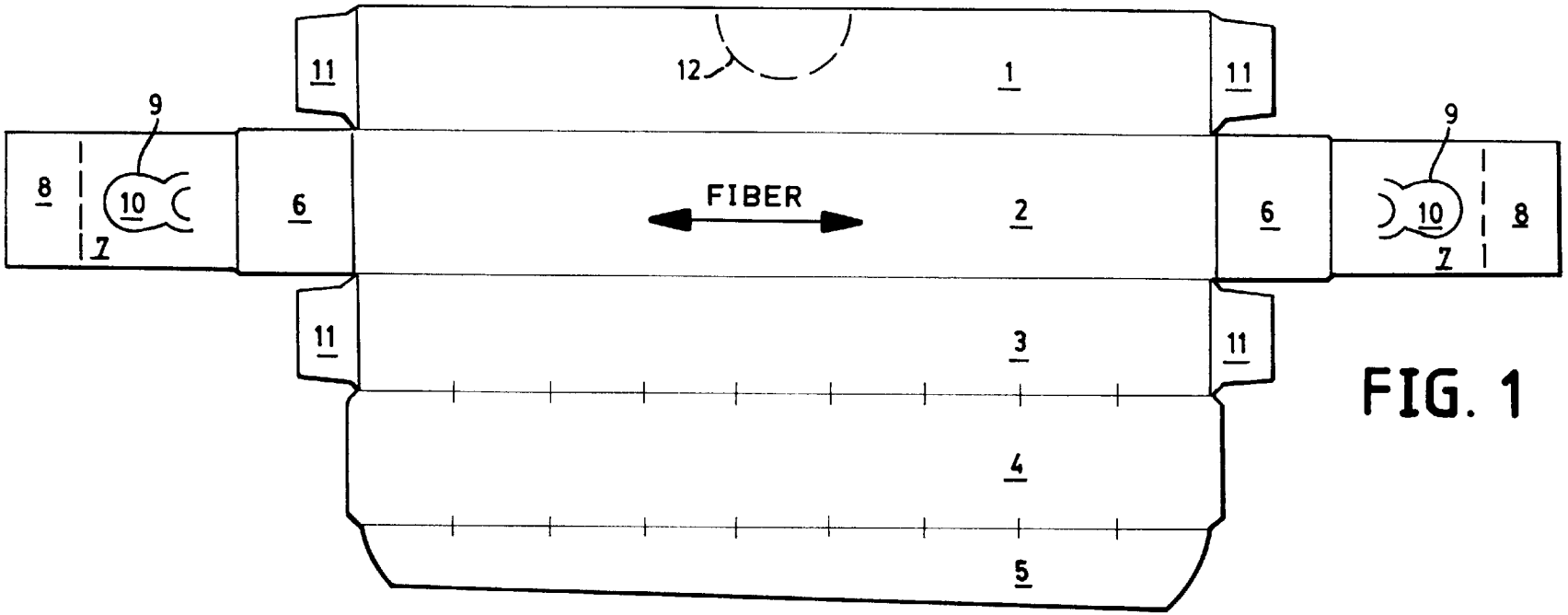
FIG. 1 shows a blank of a folding box according to the invention in the flat state.

The blank according to FIG. 1 is in a single piece and comprises four body sections, namely a front-wall section 1, a base section 2, a rear-wall section 3 and a cover section 4, which is adjoined by an insertion flap 5. The sections 1, 2 and 3 are connected to one another at folding lines. The folding line between the sections 3 and 4 is preferably alternately grooved and cut in order to facilitate folding, and the folding line between the section 4 and the insertion flap 5 is preferably alternately grooved and scored in order to simplify the folding-over operation. The cover section 4 is somewhat longer than the sections 1, 2 and 3 so as to ensure a reliable closure in the closed state, in that, in the folded state, it projects beyond the side sections 6, which are provided on the base section.

The side sections 6 are each adjoined by a section which forms a retaining tab 7 and bears an adhesive tab 8 at the end. Formed in each retaining tab 7 is an essentially U-shaped cut line 9 which bounds a tongue 10. The front-wall section 1 and the rear-wall section 3 are adjoined laterally by adhesive tabs 11. In the center, the front-wall section 1 has an arcuate broken line 12 which extends from the free border and ends in the latter again.

In order to produce a folding box from said blank, the front-wall section 1 and rear-wall section 3 are erected on the base section 2, there adhesive tabs 11 are bent over, and then the side-wall sections 6 are bent upward and adhesively bonded to the outer sides of the adhesive tabs 11. The retaining tabs 7 are folded into the interior of the folding box and their adhesive tabs 8 are adhesively bonded to the base section 2. The retaining tabs 7 then run at an angle of approximately 45° to the base section 2.

Figure 2:
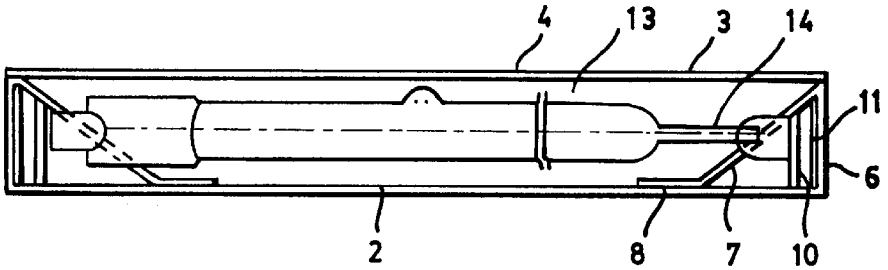
FIG. 2 shows, in a natural size, a sectional illustration through a folding box which is filled with a tubular halogen lamp and is produced from the blank according to FIG. 1.

According to FIG. 2, said folding box is suitable for receiving a tubular halogen lamp, the latter being designated by 13 in FIG. 2. It can be seen that the ends of the lamp 13 are retained in the cut-outs, formed by the cut lines 9, of the retaining tabs 7, the lamp ends being supported in the longitudinal direction.

In this respect, FIG. 2 shows two possible positions of the tubular lamp 13. In the case of the variant which is illustrated to the left of the broken line, the lamp ends are mounted in a resiliently cushioned manner by the tongues 10 which are bounded by the cut lines 9 and of which the free end is adjacent to the base section 2 in each case and may, if appropriate, be supported thereon, which increases the stability of the support provided by the tongues 10. In the case of the variant illustrated to the right of the broken line, the tubular lamp 13 has been rotated through 90° about its longitudinal axis. In this position, the flat end section 14 of the tubular lamp 13 is additionally supported on the end side by the retaining tab 7, this additionally securing the lamp in the longitudinal direction.

When the folding box is in the closed state, the insertion flap 5 may be adhesively bonded to the front-wall section 1 in the region which is bounded by the broken line 12. This ensures an originality closure which can easily be torn open. Once the packaging has been torn open, the tubular lamp 13 is exposed and can easily be gripped by one's fingers.

It goes without saying that, if the base section 2 and cover section 4 as well as the side sections 6 and attached retaining tabs 7 are widened correspondingly and if there is a corresponding number of arcuate cut lines 9, it is also possible for a plurality of tubular lamps to be accommodated in one packaging container according to the invention.

What is claimed is:

1. A folding box for receiving at least one elongated article, comprising a packaging body made of four elongate body sections, of which one forms a cover flap provided with an insertion flap and which are connected to one another at folding lines to give a single-piece blank, on which there are also provided side sections and folding tabs and two retaining tabs which form mutually opposite inserts in the folding box and each have at least one through-passage for supporting the ends of the at least one article and are each adhesively bonded to a common base section by means of an adhesive tab, wherein the inserts each comprise a retaining tab (7) which extends from a side section (6) and, in the folding-box body, runs obliquely from the side section (6) in the direction of the base section (2), on which the relevant side section (6) is provided, and wherein the side sections (6) are adhesively bonded to the folding tabs (11), which are provided on the two adjacent body sections (1, 3).

2. The folding box as claimed in claim 1, wherein the through-passage in each retaining tab (7) is bounded by a U-shaped cut (9), the central or arcuate leg of said cut running adjacent to the base section (2), on which the retaining tab (7) is adhesively bonded.

3. The folding box as claimed in claim 1, wherein separated off on the body section (1), which is located opposite the insertion flap (5), is a subregion of an arcuate broken line (12) which ends at the free border of the body section (1) and can be adhesively bonded to the insertion flap (5) inserted into the folding box.

4. The folding box as claimed claim 1, wherein the body section which forms the cover section (4) is longer than the other body sections (1, 2, 3) by approximately 2 to 5 material thicknesses.

5. The folding box as claimed claim 1, wherein the body section (4) is separated off from the adjacent body section (3) by a line of alternating grooves and cuts.

6. The folding box as claimed claim 1, wherein the insertion flap (5) is separated off from the adjacent cover section (4) by a line of alternating grooves and scores.

7. The folding box as claimed in claim 2, wherein separated off on the body section (1), which is located opposite the insertion flap (5), is a subregion of an arcuate broken line (12) which ends at the free border of the body section (1) and can be adhesively bonded to the insertion flap (5) inserted into the folding box.

8. The folding box as claimed claim 2 wherein the body section which forms the cover section (4) is longer than the other body sections (1, 2, 3) by approximately 2 to 5 material thicknesses.

9. The folding box as claimed claim 2, wherein the body section (4) is separated off from the adjacent body section (3) by a line of alternating grooves and cuts.

10. The folding box as claimed claim 2, wherein the insertion flap (5) is separated off from the adjacent cover section (4) by a line of alternating grooves and scores.

* * * * *